United States Patent [19]

Warren

[11] 4,106,132

[45] Aug. 15, 1978

[54] SITZ BATH

[76] Inventor: Albert D. Warren, New Hydes Ferry Pike, Nashville, Tenn. 37218

[21] Appl. No.: 774,961

[22] Filed: Mar. 7, 1977

[51] Int. Cl.[2] ..... A47K 3/22

[52] U.S. Cl. ..... 4/6; 4/185 L; 4/185 S

[58] Field of Search ..... 4/1, 6, 7, 134, 185 L, 4/185 S, 251; 220/324; 214/17 D; 5/85; 297/DIG. 10; 242/67.1 R

[56] References Cited

U.S. PATENT DOCUMENTS

| | | | |
|---|---|---|---|
| 338,031 | 3/1886 | Brown | 4/6 |
| 1,726,139 | 8/1929 | Blasco et al. | 214/17 D |
| 2,225,722 | 12/1940 | Spieth | 220/324 X |
| 2,788,527 | 4/1957 | Steven | 4/185 L |
| 2,872,686 | 2/1959 | Osborn et al. | 4/6 |

*Primary Examiner*—Richard E. Aegerter
*Assistant Examiner*—Stuart S. Levy
*Attorney, Agent, or Firm*—Harrington A. Lackey

[57] ABSTRACT

A sitz bath including a frame supporting an elongated flexible seat member at its ends for suspension within a liquid receptacle, or tub, and including a windlass about which one end of the seat member is wound for lowering and raising the seat member to various elevations within the receptacle.

4 Claims, 8 Drawing Figures

SITZ BATH

BACKGROUND OF THE INVENTION

This invention relates to a sitz bath, and more particularly to an adjustable seat member for a sitz bath.

Sitz baths are, of course, well-known in the art for supporting a patient in a sitting posture to bathe the hips, thighs and posterior area of the patient with hot water or other bathing or therapeutic solution.

Portable sitz baths are also well-known in the art as disclosed in the Gaston U.S. Pat. No. 2,139,951; the Osborn U.S. Pat. No. 2,872,686 and the Strouse U.S. Pat. No. 3,132,349. The Osborn and Strouse patents also disclose flexible seat members supported upon a frame above a liquid receptacle or tub, and having an opening therein for bathing the posterior area of a patient seated upon the flexible seat member.

However, none of these prior patents disclose flexible seat members adapted to be positively raised and lowered, in order to lower a seated patient into the bathing solution, and to raise the patient from the solution after the bath is completed.

Furthermore, none of the prior patents, or any other known sitz baths, include detachable fastening means for removing the flexible seat member from its supporting frame for cleansing and sterilization.

SUMMARY OF THE INVENTION

It is therefore an object of this invention to provide a sitz bath having a flexible seat member with its ends detachably connected to a supporting frame, and with means for raising and lowering the seat member relative to the support frame and the tub or liquid receptacle.

More specifically, this invention contemplates a sitz bath including an elongated flexible seat member of sheet material, such as a cloth or plastic fabric having an opening in the middle thereof and detachably connected at its front and rear ends to corresponding portions of a supporting frame. The rear end portion of the seat member is supported higher than the front end portion to provide a back rest for the seated patient, and to permit the legs of the patient to hang over the front end portion of the frame.

The supporting frame may be formed integrally with, or detachably connected to, a liquid receiving receptacle beneath the seat member for containing hot water or a cleansing or medicated solution for treating the posterior area of the patient seated in the seat member within the receptacle.

One end portion, and preferably the front end portion, of the flexible seat member is wrapped, or wound, upon a transverse rotary spindle, forming a part of a windlass mechanism. The windlass mechanism may be rotated manually, or by power means, to wind and unwind the front portion of the fabric member about the spindle, and to correspondingly raise and lower the seat member relative to the supporting frame and the receptacle. In this manner, a patient seated in the seat member can be lowered into the receptacle for immersion within the heated or cleansing solution within the receptacle, and can then be positively raised from the receptacle, after the bath is completed.

In a preferred form of the invention, the seat-supporting frame may be detachably connected to the receptacle, and may be further provided with wheels or casters to render the entire bath assembly portable. Moreover, the receptacle can be detached from the portable seat-supporting frame, and the supporting frame and seat, with or without a seated patient, can be moved to a site different from the location of the receptacle.

The maneuverability options are several. The patient may be transported to and from the receptacle. The receptacle may be transported to the bathing area, and subsequently to an area for emptying and cleaning the receptacle. The patient and the receptacle may be transported from the patient's living area to a bathing area.

DESCRIPTION OF THE PREFERRED EMBODIMENTS

Figures 1, 2, 3, 4, 5, 6, 7, 8:
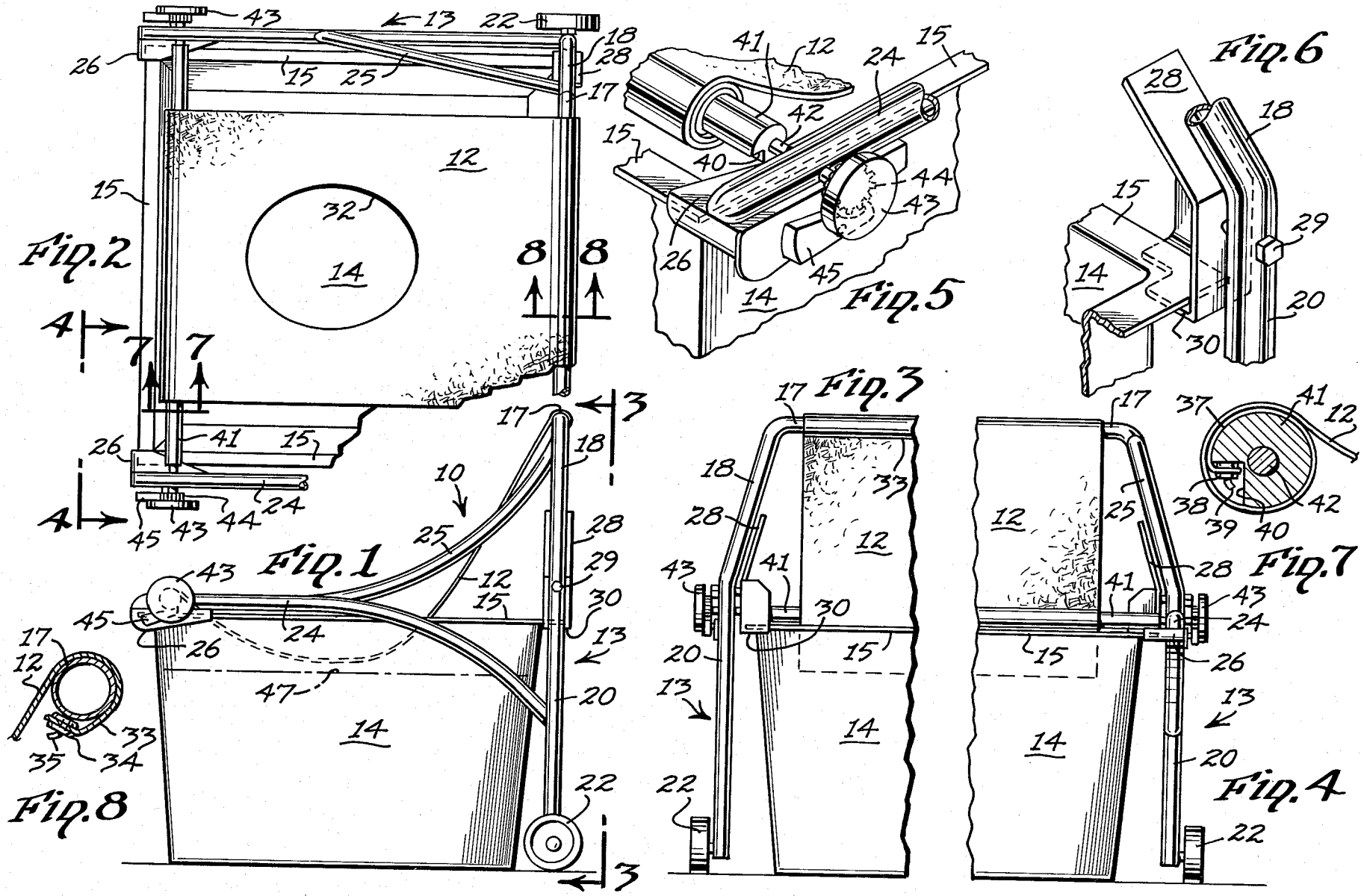
FIG. 1 is a left-side elevation of the sitz bath made in accordance with this invention.
FIG. 2 is a fragmentary, top plan view of the sitz bath disclosed in FIG. 1.
FIG. 3 is a fragmentary, rear elevation of the left-hand portion of the sitz bath taken along the line 3—3 of FIG. 1.
FIG. 4 is a fragmentary, front elevation of the right-hand portion of the sitz bath taken along the line 4—4 of FIG. 2.
FIG. 5 is a fragmentary, top front, left-side perspective view of the sitz bath, disclosing the windlass mechanism.
FIG. 6 is a fragmentary, top rear, left-side perspective view of the sitz bath, disclosing the lever latch.
FIG. 7 is an enlarged, fragmentary section taken along the line 7—7 of FIG. 2.
FIG. 8 is an enlarged, fragmentary section taken along the line 8—8 of FIG. 2.

Referring now to the drawings in more detail, the sitz bath, or sitz bath assembly, 10, disclosed in the drawings, includes an elongated, flexible seat member 12 having its front and rear ends supported upon a frame device including a support frame 13 and a liquid receptacle or tub 14. The support frame 13 may be detachably connected to the receptacle 14, as disclosed in the drawings, or the support frame 13 may be integrally formed with the receptacle 14.

The receptacle 14 may be of any desired shape, so long as it is large and deep enough to receive the posterior area of the patient seated in the seat member 12, and adapted to receive a sufficient volume of liquid for immersion of the posterior area of the seated patient. The liquid, of course, may be hot water, a cleansing solution, a mixture of hot water and a cleansing solution, or a medicated solution mixed with either the hot water or the cleansing solution, or both, or neither.

In a preferred form of the invention, the receptacle 14 is provided with outward directed lateral ledges or flanges 15 projecting from the top edge of the walls of the receptacle 14.

As disclosed in the drawings, the support frame 13 includes a rear transverse frame member or bar 17, terminating in depending and diverging bars 18, which in turn merge with rear support legs 20. At the lower extremity of each of the legs 20 is journaled a rear caster or wheel 22.

Fixed to each rear leg 20, by welding or other convenient means, is an arcuate, forwardly extending, side frame bar 24, the front portion of which is substantially straight. A curved reinforcing bar 25 connects each side frame bar 24 to the depending bar 18, for strength and rigidity. All of these frame bars may be constructed of any desired material, but are disclosed in the drawings as being made from round tubular steel stock.

The front end of each side frame bar 24 is fixed to a hook-shaped, cup-shaped, or pocket-shaped, attachment member 26 adapted to fit over and receive the intersecting flanges or ledges 15 forming the front corners of the receptacle 14. When the frame 13 is moved forward relative to the receptacle 14, the cup-shaped attachment members 26 move away from, and disengage the front corner ledges 15, to disconnect the frame 13 from the receptacle 14.

In order to hold the frame 13 in its assembled position connected to the receptacle 14, after the pocket-shaped attachment members 26 engage the corresponding front corners of the ledges 15, a latch lever 28, pivotally connected by pin 29, to each of the upper portions of the legs 20, is rotated clockwise, as viewed in FIGS. 1 and 6, to thrust the hook-shaped latch element, at the bottom end of the latch lever 28, into engagement beneath the intersecting ledges 15 at the rear corners of the receptacle 14. When the latch lever 28 is thrust forward or counter-clockwise, as viewed in FIG. 1, the hook-shaped latch end 30 is removed from the rear ledge corners 15, to permit the front cup-shaped attachment members to be released from the front ledge corners of the receptacle 14.

The flexible seat member 12 is preferably an elongated piece of sheet material, which is not only flexible, but which is strong enough to support the seated patient in a suspended position from the frame 13 and within the receptacle 14. Furthermore, the sheet material from which the seat member 12 is made is adapted to be easily cleaned and sterilized, such as a piece of cloth fabric, or a sheet of plastic material. A cloth fabric seat member 12, when detached from the support frame 13 can be easily laundered with other cloth fabric articles, such as clothing, or bed clothing, by conventional laundry methods within a hospital or the home.

The seat member 12 is also provided with a hole or opening 32 in the middle portion thereof, adapted to register with the posterior area of the seated patient, and expose the posterior area to the hot water or other bathing solution within the receptacle 14.

The rear end portion 33 (FIG. 8) of the flexible seat member 12 is detachably connected to the rear transverse bar 17 of the support frame 13. As disclosed in FIG. 8, a grommet 34 is formed in the rear end portion 33 for engagement with a hook 35 fixed to and projecting from the transverse bar 17. Although only one grommet 34 and hook 35 may be seen in FIG. 8, nevertheless it will be understood that a plurality of such mating grommets 34 and hooks 35 will be spaced across the length of the transverse bar 17. The hooks 35 are so located that they will not penetrate the fabric of the seat member 12, or punch or prick, the skin of the patient seated in the seat member 12. As disclosed in FIG. 8, the hooks 35 are located along the bottom of the transverse bar 17, and the rear end portion 33 is wrapped around the bar 17 in frictional engagement for additional support.

The front end portion 37 of the seat member 12 may also be provided with a plurality of transversely spaced grommets 38 for registering with and receiving corresponding hooks 39 formed in an elongated concealed notch 40 upon a windless drum or spindle 41, as disclosed in FIG. 7. The front end portion 37 of the seat member 12 is also wrapped about the spindle 41 in frictional engagement. The drum or spindle 41 is mounted coaxially upon a shaft 42, the opposite ends of which are journaled through bearig holes in the front portions of the side frame bars 24. Fixed to the outer ends of the spindle shaft 42 are hand wheels 43, for manually rotating the shaft 42 and the spindle 41 in order to wind and unwind the front portion 37 of the seat member 12, thereby raising and lowering the seat member 12 relative to the frame 13 and the receptacle 14.

Fixed coaxially upon the spindle shaft 42 between either, or both hand wheels 43, and the corresponding side frame bar, or bars, 24 is a ratchet wheel 44 adapted to be engaged by pivotal pawl 45 mounted upon the side of the cup-shaped attachment member 26. Preferably, the pawl 45 is biased into engagement with the ratchet wheel 44 so that the drum 41 will be latched against unwinding by the weight of the seated patient within the seat member 12. The pawl 45 may be manually pivoted against the action of a biasing spring, not shown, in order to release the pawl 45 from the ratchet 44, when it is desired to turn the hand wheel 43 in either direction for winding or unwinding the seat member 12 upon the drum 41.

It will also be understood that the windlass spindle 41 may be driven in either direction by power means, such as an electrical motor drivingly connected to the spindle shaft 42 in place of the hand wheel 43.

Timer means could also be connected to an electric motor to drive the spindle 41 in one direction in order to lower the patient into the solution within the receptacle 14, and after the patient has been bathed for a predetermined time, the timer mechanism would actuate the motor to a reverse mode for winding the seat member 12 upon the spindle 41 in order to raise the patient from the bath within the receptacle 14.

The notch 40 is provided within the windlass drum 41 in order to protect the overhanging legs of the patient from the projecting hooks 39.

In the operation of the sitz bath 10, a clean and sterilized seat member 12 is suspended from the frame 13 by attaching the upper rear end portion 33 upon the hooks 35, and attaching the front end portion 37 to the hooks 39. The spindle 41 is then rotated by the hand wheel 43 to raise the seat member 12 to an elevated position above the level 47 of the bathing solution within the receptacle 14 (FIG. 1). The receptacle 14 is, of course, filled with the desired bathing solution, such as pure hot water, or a cleansing or medicated solution. The support frame 13 is connected to the receptacle 14 by engaging the front cup-shaped attachment members 26 and the latch levers 28 with the respective front and rear corners of the ledges 15.

The patient is then positioned so that he is seated upon the seat member 12 with his posterior area registering with the hole 32. The seated patient's back leans against the inclined rear portion of the seat member 12, while his legs hang over the front portion 37 of the seat member supported by the spindle 41. The patient, or the operator or attendant, then releases the pawl 45. The weight of the patient causes the seat member 12 to unwind from the rotating spindle 41, to lower the patient into the solution within the receptacle 14. The unwinding may be controlled by grasping and braking the hand wheel 43. When the seat member 12, including the posterior area of the patient, has been lowered below the solution level 47, (FIG. 1), the patient or attendant holds the hand wheel 43, while he re-engages the pawl 45 with the ratchet wheel 44 to lock the seat member 12 in its lowered position in the bathing solution.

After the bath is completed, the hand wheel 43 is then counter-rotated in a counter-clockwise direction to wind up the front end portion 37 of the seat member 12, until the patient has been lifted to an elevation above the bathing solution level 47. The pawl 45 automatically holds the ratchet wheel 44, spindle 41 and seat member 12 in the corresponding elevated position.

After the patient is removed from the seat member 12, frame 13 may be disconnected from the receptacle 14, by pivoting the latch lever 28 to disengage the latch hook 30 from the rear corner flanges 15, and then moving the frame 13 forward to disengage the cup-shaped attachments 26 from the front corners of the flanges 15. The receptacle 14 is then emptied, cleaned and disinfected. Of course, if the receptacle 14 is to be cleansed in a different location, the operator may push the frame 13 to a cleansing station, before the frame 13 is disconnected from the receptacle 14.

The seat member 12 is then removed by unwinding the spindle 41 until the grommets 38 may be released from the hooks 39. Then the grommets 34 on the rear portion 33 of the seat member 12 are released from the rear hooks 35. The seat member 12, then being completed disconnected from the frame 13, is cleaned, laundered or disposed of in the desired manner. A clean seat member 12 is then re-connected to the transverse support bar 17 and to the spindle 41, in preparation for the next sitz bath.

Because of the detachable connection between the frame 13 and the receptacle 14, the receptacle 14 could remain in a bath room or a bathing area, while the disconnected frame 13 could be employed for transporting the patient from his room or hospital room to the bathing area, where the frame 13 would be re-attached to the receptacle 14.

The sitz bath 10 made in accordance with this invention has marked advantages over previous sitz baths, some of which have already been described. The sitz bath assembly 10 is not only portable and easily cleaned, but safe and simple to use, convenient, not only for the patient, but also for the attendant or operator, and completely sanitary and comfortable.

What is claimed is:

1. A sitz bath comprising:

(a) a seat support frame having a front portion and a back portion, (b) said back portion comprising a rear transverse member, (c) an elongated, flexible seat member having a front end portion and a rear end portion, the longitudinal axis of said seat member extending front-to-rear, (d) rear securing means stationarily securing the rear end portion of said seat member to said rear transverse member, (e) windlass means including a rotary spindle rotatably mounted on said front portion spaced in front of, below, and substantially parallel to said rear transverse member, (f) front securing means securing the front end portion of said seat member to said rotary spindle for winding and unwinding said seat member suspended between said rear transverse member and said rotary spindle, (g) means for holding said spindle in a non-rotary position, to hold said seat member at different adjusted elevated positions relative to said frame device, so that the legs of a person seated lengthwise of the longitudinal axis of said seat member extend over said spindle, (h) a liquid-receiving receptacle, and (i) means on said seat support frame detachably connecting said receptacle below said seat member, and within which said seat member is adapted to be suspended in various adjusted elevated positions.

2. The invention according to claim 1 in which said receptacle has top flanges projecting laterally outward, and said detachable connecting means comprising hook-shaped elements engaging said flanges.

3. The invention according to claim 1 in which said front securing means detachably connects the front end portion of said seat member to said rotary spindle, and said rear securing means detachably connects the rear end portion of said seat member to said rear transverse member, and said seat member is an elongated flexible sheet member adapted to be easily cleaned.

4. The invention according to claim 1 in which an opening is formed in said seat member to register with the posterior area of a person seated on said seat member.

* * * * *